US007712624B2

(12) United States Patent
Scarola et al.

(10) Patent No.: US 7,712,624 B2
(45) Date of Patent: May 11, 2010

(54) PLASTIC COFFEE CONTAINER WITH TOP LOAD SUPPORT BY PARTICULATE PRODUCT

(75) Inventors: Leonard S. Scarola, Basking Ridge, NJ (US); George Thomas Albright, Rutherford, NJ (US)

(73) Assignee: Kraft Foods Holdings, Inc., Northfield, IL (US)

( * ) Notice: Subject to any disclaimer, the term of this patent is extended or adjusted under 35 U.S.C. 154(b) by 708 days.

(21) Appl. No.: 11/616,336

(22) Filed: Dec. 27, 2006

(65) Prior Publication Data

US 2008/0156765 A1 Jul. 3, 2008

(51) Int. Cl.
*B65D 8/00* (2006.01)
*B65D 51/16* (2006.01)

(52) U.S. Cl. ..... 220/675; 220/203.29

(58) Field of Classification Search ..... 220/359.2, 220/359.1, 203.29, 203.01, 254.1, 258.3, 220/258.2, 258.1, 380; 215/311, 232, 379; 53/485, 484; 206/504
See application file for complete search history.

(56) References Cited

U.S. PATENT DOCUMENTS 2,110,012 A 3/1938 Auban
2,416,900 A * 3/1947 Busby ..... 215/307
2,423,358 A * 7/1947 Hohl et al. ..... 53/432
2,620,938 A * 12/1952 Jesnig ..... 215/254
3,056,244 A 10/1962 Bartels
3,103,089 A 9/1963 Allen
3,105,765 A 10/1963 Creegan
3,117,873 A 1/1964 Bartels et al.
3,163,311 A * 12/1964 Stolk ..... 426/106
3,167,202 A * 1/1965 Tolciss ..... 215/307
3,405,744 A 10/1968 Bowman
3,410,436 A * 11/1968 Foss et al. ..... 215/253
3,517,475 A 6/1970 Balocca
3,586,066 A 6/1971 Brown
3,821,427 A 6/1974 Enzie et al.
4,098,404 A 7/1978 Markert
4,154,045 A 5/1979 Christensson (Continued)

FOREIGN PATENT DOCUMENTS

EP 0 357 276 3/1990

(Continued)

*Primary Examiner*—Anthony Stashick
*Assistant Examiner*—Robert J Hicks
(74) *Attorney, Agent, or Firm*—Stites & Harbison PLLC; Marvin Petry; Douglas E. Jackson

(57) ABSTRACT

A rigid container for a particulate product with enhanced top load support includes an interior volume formed by a base, a surrounding wall member upstanding from the base, and an opening formed in a top. A particulate product, such as coffee, is provided in the interior volume, and is provided in sufficient quantity to fill the interior volume up to a predetermined minimum headspace. The predetermined minimum headspace is that headspace which produces a top load ratio of at least 3:1; where the top load ratio is defined as a ratio of the top load force sufficient to cause a 0.30" deflection in the container when filled to the top load force sufficient to cause a 0.30" deflection in the container when empty. In a preferred embodiment, the container is made of plastic and includes a flexible closure attached to the top and spanning the top opening.

20 Claims, 2 Drawing Sheets

U.S. PATENT DOCUMENTS 4,560,077 A * 12/1985 Dutt ..... 215/307
4,804,550 A 2/1989 Bardsley et al.
4,957,753 A 9/1990 Bardsley et al.
4,966,780 A * 10/1990 Hargraves et al. ..... 426/118
4,967,538 A * 11/1990 Leftault et al. ..... 53/440
5,224,613 A * 7/1993 Robbins, III ..... 215/10
5,422,129 A * 6/1995 Draddy ..... 426/115
5,617,705 A * 4/1997 Sanfilippo et al. ..... 53/432
5,688,544 A * 11/1997 Bolton et al. ..... 426/118
5,916,110 A * 6/1999 Sanfilippo et al. ..... 53/510
5,985,191 A 11/1999 Clarke
6,220,471 B1 * 4/2001 Lowry ..... 220/258.2
6,761,279 B1 * 7/2004 Martin et al. ..... 220/258.2
6,772,904 B1 * 8/2004 Gilliam et al. ..... 220/836
2002/0148804 A1 10/2002 Wurster et al.
2003/0010787 A1 1/2003 Dalton et al.
2004/0022976 A1 2/2004 Kato et al.
2004/0137110 A1 7/2004 Dalton et al.
2004/0173626 A1 9/2004 Jeor
2005/0017013 A1 1/2005 Peisach et al.
2005/0184073 A1 8/2005 Peisach et al.
2006/0096982 A1 * 5/2006 Gunter et al. ..... 220/89.1
2006/0147664 A1 7/2006 Richards et al.

FOREIGN PATENT DOCUMENTS

GB 466003 5/1937
JP 03187867 A * 8/1991

* cited by examiner

PLASTIC COFFEE CONTAINER WITH TOP LOAD SUPPORT BY PARTICULATE PRODUCT

BACKGROUND OF THE INVENTION

Containers for particulate products, especially (roast or ground) coffee particulate products, have many unique requirements which need not be considered for other containers. For example, coffee particulates give off gases while being stored, and are deleteriously affected by air. Thus, coffee particulate containers must prevent the ingress of air and hence be air-tight. In addition, such containers must also be suitably robust to withstand a build-up of pressure; or alternatively, the container must vent the built up gases before the pressure thereof damages (miss-shapes or breaks) the container or be subject to an initial vacuum so that any build up of pressure is not excessive.

While particulate coffee containers were previously generally made of metal formed into a cylinder with a top and a bottom (which was thus easily made robust and air-tight), new cylindrical and other shaped rigid plastic containers, particularly with layered walls, have now been found to be suitable for containing particulate coffee. However, while such plastic containers have sufficient size to store a desired volume of particulate coffee, typically in the range of 2-4 pounds and have diameters and heights of about 5-7 inches, such containers have been expensive to make. This expense includes the material needed to make the container walls sufficiently strong so that such containers can support a sizable top load, such as from other containers stored thereabove in a pallet during shipping.

BRIEF SUMMARY OF THE INVENTION

In accordance with the present invention, a rigid container for a particulate product with enhanced top load support is provided. The rigid container includes a main interior volume formed by a base, a surrounding wall member upstanding from the base, and a top. A particulate product, such as coffee, is provided in the interior volume. This particulate product is flowable and is provided in sufficient quantity to fill the interior volume up to where a predetermined minimum headspace is provided. The predetermined minimum headspace is that headspace which produces a top load ratio of at least 3:1; where the top load ratio is defined as a ratio of the top load force sufficient to cause a 0.30" deflection in the plastic container when filled to the predetermined minimum headspace over the top load force sufficient to cause a 0.30" deflection in the plastic container when empty.

In a preferred embodiment, the rigid container further includes an enlarged top opening and a flexible closure attached to the top and spanning the top opening. Then, the predetermined minimum headspace is also sufficient so that when a pressure of the main interior volume is about 3 psi less than ambient, which pressure causes the flexible closure to flex inward, more than about 20% of the flexible closure contacts a top portion of the particulate product.

In the preferred embodiment, the surrounding wall member has a wall thickness which is greater adjacent the top than adjacent the base. This is preferably accomplished in one embodiment by having the wall thickness of the surrounding wall member change gradually from adjacent the top to adjacent the base. In another embodiment, the thickness of the top half is twice that of the bottom half.

In various embodiments, the surrounding wall member is generally curved in cross section (such as being circular or oval) or rectangular (such as square); and is advantageously made of plastic. Preferably, the particulate product is compacted coffee, and the main interior volume holds at least one liter of the coffee therein and is able to vent excess pressure therein to atmosphere through a suitable one-way valve which is most preferably provided in the flexible closure.

Also in accordance with the present invention, a method for reinforcing a rigid container for a particulate product against top load forces is provided. This method includes the step of forming a rigid container with a container main interior volume formed by a base, a surrounding wall member which is upstanding from the base, and a top which connects with the surrounding wall member and which includes an opening therein. Next, the main interior volume is filled with a particulate product so that at least a predetermined minimum headspace is provided. This predetermined minimum headspace is that which produces a top load ratio of at least 3:1, as described above.

Preferably, after the filling step, a flexible closure is attached to the top and spans the top opening. In addition, the predetermined minimum headspace is also sufficient so that about 20% of the flexible closure contacts a top portion of the particulate product when a pressure of the main interior volume is 3 psi less than ambient and this pressure causes the flexible closure to flex inward.

Preferably, the filling step includes the step of vibrating the particulate product, which is preferably coffee. In addition, the flexible closure attached to and spanning the top opening includes a suitable one-way valve provided therein to vent excess pressure in the main interior volume to atmosphere. The rigid container is also preferably made of plastic, with the main interior volume holding at least one liter of the coffee. The wall thickness of the surrounding wall member also preferably reduces in thickness from top to bottom, most preferably gradually or by having the top portion twice as thick as the bottom portion.

The surrounding wall member is generally curved in cross section (such as circular or oval) or rectangular (such as square).

It is an advantage of the present invention that a rigid container containing a particulate product includes an increased top load strength provided by a predetermined minimum headspace so that the container walls do not need to provide a majority of the top load support.

It is also an advantage of the present invention that the container walls can be of reduced thickness, resulting in a savings of raw materials for the container.

It is a further advantage of the present invention that a one-way valve for releasing off gases produced by coffee is provided.

Other features and advantages of the present invention are stated in or apparent from detailed descriptions of presently preferred embodiments of the invention as discussed in greater detail below.

DETAILED DESCRIPTION OF THE INVENTION

Figure 1:
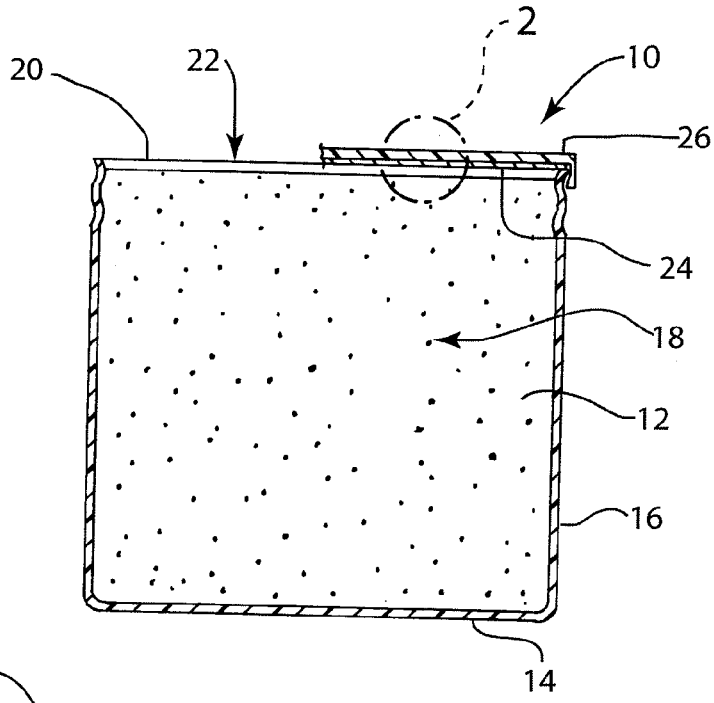
FIG. 1 is a cross sectional elevation view of a coffee container according to a first embodiment of the present invention.

With reference now to the drawings in which like numerals represent like elements in the views, a rigid particulate coffee container 10 according to a first embodiment of the present invention is shown in FIG. 1. It will be appreciated that container 10 hereafter described is rectangular or actually square in cross section, i.e., as having a basic square footprint of about 6.2"×6.2" and a height of about 6.5". However, container 10 could also be of different cross sectional shapes as discussed hereinafter and as disclosed in Ser. Nos. 11/353,091, 11/353,092, and 11/353,093 filed Feb. 14, 2006 by GRUSKIN et al. and Ser. No. 11/498,141 by Scarola (all assigned to the same assignee) which are hereby incorporated by reference; and container 10 is also preferably similar to any one of the containers described those serial numbers.

Like the containers described in the above serial numbers, container 10 is designed for containing fresh ground or roast (particulate) coffee 12 or a similar flowable particulate product such as a powdered beverage mix, the particles of which are relatively non-compressible. Similarly, container 10 is also made of a suitable blow-molded plastic, such as high density polyethylene (HDPE), preferably by an extrusion blow molding rotary process or other like process. One preferred layered material of a plastic coffee container includes an EVOH layer and is disclosed in Ser. No. 11/498,140 filed Aug. 3, 2006 by Scarola (and assigned to the same assignee) which is hereby also incorporated by reference.

In accordance with the present invention, container 10 includes a generally square base 14 with an integrally formed surrounding square wall member 16 extending upwardly therefrom. In order to allow easy withdrawal of coffee 12 from a main interior volume 18 of container 10 defined by base 14, surrounding wall member 16 and a top 20, it will be appreciated that container 10 has a large opening 22 in top 20. Opening 22 is preferably round and centered in surrounding wall member 16, and opening 22 has a diameter only slightly less than the diameter of surrounding wall member 16. Preferably, top opening 22 is at least five inches in diameter; but no matter the shape, opening 22 has a size sufficient for a five inch cylinder to fit therethrough. Such a large opening is considered desirable in order to enable a user to easily remove coffee 12 from container 10, once the user has removed a flexible closure 24 (as discussed below) typically provided thereon. As known in the art, surrounding wall member 16 can be provided with slightly indented label receiving portions (not shown) to receive a label or labels or the like.

Closing top opening 22 is a flexible closure 24, typically in the form of a thin foil, film plastic or other suitable membrane as well known in the art, adhered to the perimeter of top 20 and removed by the user after purchase. A one-way valve is provided in flexible closure 24, or alternately if desired in surrounding wall member 16, to permit controlled release of the build-up in pressure which occurs due to the off-gases generated by coffee 12 as also well known in the art. Such a one-way valve may not be necessary for container 10 if container 10 is packed under a vacuum. Finally, closing top 20 is a flexible plastic cap 26 which is releasably held on the perimeter of top 20 as well known in the art. Cap 26 is used to close top opening 22 after each use, once the consumer has permanently removed flexible closure 24 in order to access coffee 12 therein for the first time.

Figure 2:
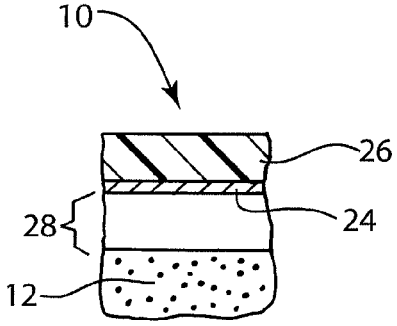
FIG. 2 is an enlarged view of the portion of the container of FIG. 1 identified with the broken out section line numbered 2.

As noted above, one problem with prior art rigid containers is that they can be expensive to make in view of the strong structural top load support which container 10 (and in particular surrounding wall member 16) must provide. In particular, after initial filling and during shipping, container 10 can have for example nine or more similar containers 10 supported thereabove in a pallet or the like, creating a substantial top load on the bottommost container 10. Such a large top load is accommodated by container 10 in accordance with the present invention by having coffee 12 filled to a predetermined minimum headspace 28, as shown best in FIG. 2.

The mechanism by which container 10 with a predetermined minimum headspace 28 can support a large top load in accordance with the present invention is not well understood, and must determined by the individual container type which is to be used and the properties of that type of container. However, the predetermined minimum headspace 28 needed is readily determinable by simple trial and error in view of the following. It is also believed that container 10 of the present invention must have some minimum volume in order for the particular product therein to function to provide a sufficient top load, which volume is on the order of one liter or more.

When a top load is applied to a rigid container, such as plastic container 10, container 10 experiences some minor compression due to the plastic material from which it is made and its various other properties. This minor compression is acceptable as it occurs without harm or adverse appearance, and is typically designed into any such container 10 and is on the order of 0.3". Prior art plastic containers have withstood such large top loads at such a minor compression of 0.3" by making the surrounding wall member sufficient thick. However, the present invention instead relies on the surprising resistance to compaction that coffee 12 experiences when it is filled into container 10 up to the predetermined minimum headspace 28. In particular, when container 10 experiences a large top load and container 10 is compressed downwards by some amount (e.g., 0.3"), due to the nature of coffee 12, the particulates thereof are not easily compressed. Thus, a significant resistance force is generated by coffee 12 before the acceptable 0.3" compression is reached.

Figure 3:
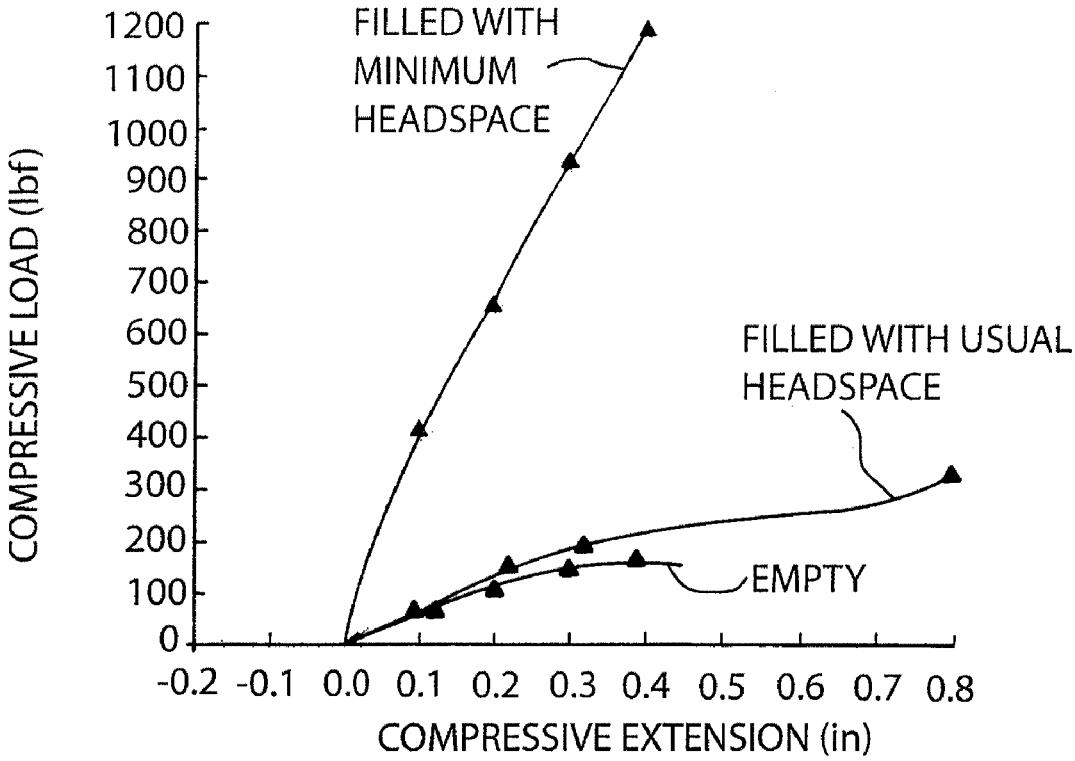
FIG. 3 is a graphical representation of the effect of the present invention showing load versus compression for three containers.

In experiments conducted to assess the resistance force offered by coffee 12 (and hence alternatively usable to predetermine what minimum headspace is required in a container), it was found that the resistive force is quite substantial when headspace 28 is sufficiently short. In particular, as shown in FIG. 3, a 142 gram weight (standard, for this experiment and typical in the art) container experienced substantial compression when a force advancing at 0.25"/minute was evenly applied (via a piece of wood) across the top. This empty container did not offer much resistance to deformation until destructive deformation occurred (where the line stops). For comparison, with this standard container then filled with what would be a normal amount of coffee (1107 grams) leaving a typical for the art headspace of 1.25" below the top (where a flexible closure would be), some slight additional resistance to compression was experienced and further compression was tolerated without destructive deformation. However, as shown, when this standard container was filled with coffee to a predetermined minimum headspace below the top, substantial resistance to compression was experienced up to the limit of the testing machine and without destructive deformation of the container.

As shown in FIG. 3, container 10 with no contents experiences a load of about 191 lbf sufficient for container 10 to be compressed 0.30", while container 10 with coffee sufficient to fill the container after vibration of coffee 12 up to a predetermined minimum headspace 28 (about ⅜ inch) experienced a load of about 931 lbf sufficient for container 10 to be compressed 0.30". This graph thus shows a 4.87:1 top load ratio—where the top load ratio is the ratio of the forces applied to produce a 0.30" compression for a filled container and for an empty container. Such a high top load ratio is a significant advantage as discussed hereafter. It is thus evident that with the present invention over one half, and in fact preferably most, of the top load on a container is supported by the coffee itself contained therein. Thus, it is a feature of the present invention that the container has a predetermined minimum headspace 28 sufficient for a top load ratio of at least 3:1.

Experiments were also performed to access the top load capacities of various prior art containers with various particulate products therein. The experiments were conducted with a 0.30" compression of the top, when the containers first off the shelf or full and then when empty, where the load was applied to an open top (there was no flexible closure present). The results of these experiments are as follows (with the data on the present invention also presented last for easy comparison).

| PRODUCT | EMPTY LOAD | FULL LOAD | RATIO |
|---|---|---|---|
| Folgers 1 lb | 121.3 | 182.57 | 1.51 |
| Folgers 3 lb | 172.16 | 326.17 | 1.89 |
| Folgers 4 lb | 271.75 | 380.42 | 1.40 |
| Hills Bros. Coffee | 145.45 | 345.51 | 2.38 |
| Kool Aid | 61.23 | 81.63 | 1.33 |
| Coffee Mate | 69.12 | 129.66 | 1.88 |
| Beef Bouillon | 81.55 | 89.58 | 1.10 |
| Antacid | 65.82 | 59.63 | 0.91 |
| Cat Litter | 40.5 | 39.88 | 0.98 |
| Pistachio Nuts | 56.57 | 130.85 | 2.31 |
| Garlic Salt | 181.8 | 472.41 | 2.60 |
| Invention-Coffee | 191 | 931 | 4.87 |

Other specifics about these tested containers are:

| PRODUCT | EMPTY WEIGHT | CONTENTS WEIGHT | SIZE | MATERIAL |
|---|---|---|---|---|
| Folgers 1 lb Coffee | 48 g | 326 g | 5.25" H, 4" D | HDPE |
| Folgers 3 lb Coffee | 115 g | 1100 g | 6.5" H, 6.5" D | HDPE |
| Folgers 4 lb Coffee | 163 g | 1470 g | 8.5" H, 6.5" D | HDPE |
| Hills Bros. Coffee | 195 g | 1100 g | 6.5" H, 6" × 6" B | multilayer |
| Kool Aid | 39 g | 19 oz | 5" H, 3.5" D | HDPE |
| Coffee Mate | 39.98 g | 10.2 oz | 6" H, 2.5" D | HDPE |
| Beef Bouillon | 25.1 g | 3.4 oz | 5" H, 1 13/16" D | |
| Antacid | 22.3 g | 180 g | 5" H, 2" × 1.5" B | PP |
| Cat Litter | 84 g | 7 lb | 8.75" H, 6" × 6" B | HDPE |
| Pistachio Nuts | 34 g | 6 oz | 6" H, 2.5" D | PETE |
| Garlic Salt | 31 g | 9.5 oz | 5" H, 2" D | PETE |
| Invention-Coffee | 142 g | 1275 g | 6.5" H, 6.2" × 6.2" B | multilayer |

It is thus seen that such prior art plastic containers with their provided headspace do not have a minimum headspace sufficient to provide a top load ratio of 3:1 in accordance with the present invention.

As a result of the ability of coffee 12 to provide substantial resistance to a large top load, it is possible to reduce the wall thickness of surrounding wall member 16 since the container need not be sufficiently rigid by itself to withstand such a (or most of a) large top load. This reduction in wall thickness can effect a substantial cost savings for the container, as the cost of the material is often a significant expense.

Figure 4:
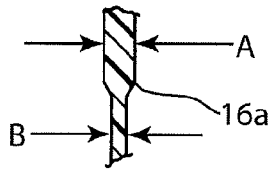
FIG. 4 is a cross sectional view of an alternative embodiment of a portion of a surrounding side wall member according to the invention.

Thus, in one preferred embodiment as depicted in FIG. 4, surrounding wall member 16 has a wall thickness A for a top half of surrounding wall member 16, and a wall thickness B for the lower half. For example, wall thickness A could be twice that of wall thickness B. A thicker wall thickness is needed at the top rather than the bottom because coffee 12 will provide some additional compressive support to surrounding wall member 16*a*, which support by coffee 12 will increase the closer it is to the base.

Figure 5:
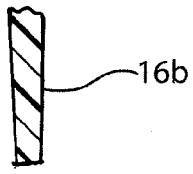
FIG. 5 is a cross sectional view of another alternative embodiment of a portion of a surrounding side wall member according to the invention.

In an alternative embodiment depicted in FIG. 5, the wall thickness of surrounding wall member 16*b* varies over the height, from a maximum adjacent the top to a minimum adjacent the base. For example, the thickness could vary from 145 mil to 90 mil.

The present invention also includes a method of protecting a plastic container for a particulate product against top load forces. In accordance with this method, plastic container 10 is first formed to provide the main interior volume 18 as desired and the large opening 22. Then, main interior volume 18 of container 10 is filled with particulate coffee 12 so that a minimum headspace 28 is left; after which typically a flexible closure is attached to top 20. In this preferred embodiment, the flexible closure is flexible closure 24, but if a flexible closure or the like is not needed or desired, the flexible closure could be whatever closing member, including cap 26, is used. Cap 26 can be a snap-on type as depicted, or a screw-on cap if desired.

Due to the compacting nature of the particulate coffee 12 used, it is desired to compact coffee 12 during filling of and once inside of main interior volume 18. This compacting is done to make sure that container 10 has an actual headspace slightly smaller than the predetermined minimum headspace 28, since coffee 12 is likely to further settle during shipping or the like and hence the actual headspace might be increased to the point where the predetermined desired headspace 28 is not provided and hence coffee 12 is not able to contribute significantly to the top load resistance. The amount of further settling that coffee 12 is likely to experience during shipping is relatively small however, and easily determined by those of ordinary skill, so only a little extra filling of coffee 12 above the level of the predetermined minimum headspace 28 is needed. Such a compacting is preferably achieved by vibration, or even by physical force.

Figure 6:
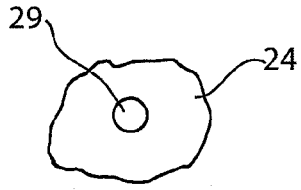
FIG. 6 is a schematic perspective top view of a portion of a flexible closure including a one-way valve in accordance with the present invention.

In order to protect container 10 against the increase in pressure produced by fresh roast or ground coffee 12, a one-way valve 29 located on flexible closure 24 as schematically depicted in FIG. 6 and well-known in the art is used. When one-way valve 29 is used, it will also be appreciated that another problem with plastic containers for coffee having a flexible closure 24 is that flexible closure 24 and the remainder of container 10 can be subject to undesirable inward deformation forces. These undesirable deformation forces may occur when container 10 is shipped over a high altitude, and hence experience a low ambient pressure. When such shipping occurs, one-way valve 29 keeps the pressure between the inside of the container 10 and the outside at a relatively set amount such as (positive) 0.1 psi. Consequently, at the peak or greatest vertical height of shipping (lowest ambient pressure), the inside of the container 10 will be only 0.1 psi greater than the outside or ambient pressure. Then, when the container 10 descends from the peak height, there may be a significant difference between the low pressure in the inside of container 10 and ambient, such as almost 6 psi in an extreme case. Such a large difference in pressure may then be sufficient to undesirably bow flexible closure 24 inward and/or undesirably deform container 10.

However, with the use of the minimum headspace of the present invention as described above, flexible closure 24 and the predetermined minimum headspace are designed so that at a known or determined pressure differential, preferably at about 3 psi, at least about 20% of flexible closure 24, typically the central portion, contacts the top of coffee 12 in container 10. When this happens, no further deformation of flexible closure 24 at the contacted locations can occur. And as this touching occurs, it will be appreciated that the rest of the container is supported as well by coffee 12 as described above; and in fact, the contact of flexible closure 24 also serves to push against coffee 12, further tending to resist the tendency of surrounding wall member 16 and base 14 to be pushed inward by the pressure differential. In this manner, even a relatively high pressure differential does not adversely effect container 10. Of course, the remainder (peripheral portion) of flexible closure 24 not in contact with coffee 12 does experience the pressure differential, but it is believed that as the central portion is supported by coffee 12, the remainder of flexible closure 24 is better able to withstand the pressure differential.

It will also be appreciated that where container 10 has a surrounding wall member with a reduced thickness adjacent the bottom as disclosed above for surrounding wall members 16*a* or 16*b*, a pressure differential such as discussed above will also exert a deforming force on the surrounding side wall member. While the surrounding wall member 16*a* or 16*b* of any empty container would readily collapse at the thinner portion, the use of the predetermined minimum headspace 28 of the present invention also assures that sufficient compacted coffee 12 will also be present at the thinner-lower portions of surrounding sidewall members 16*a* and 16*b* with sufficient force to resist the inwardly directed forces of any such pressure differential. Thus, the thinner thickness of surrounding side wall members 16*a* and 16*b* do not present a problem when such a pressure differential is experienced.

Figure 7:
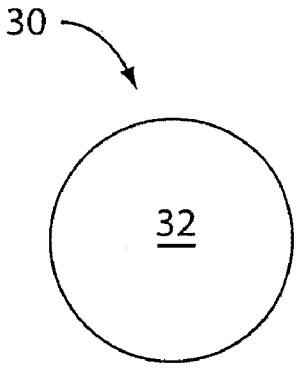
FIG. 7 is a schematic bottom view of a container according to the present invention.

Depicted in FIG. 7 is another embodiment of a plastic particulate coffee container 30 according to the present invention. It will be appreciated that container 30 has a circular base 32 as shown with an identical circular surrounding wall member (not shown) extending upwardly therefrom. Other than an circular footprint, container 30 is thus similar to container 10; and container 30 could include the same variations thereof as discussed above.

Figure 8:
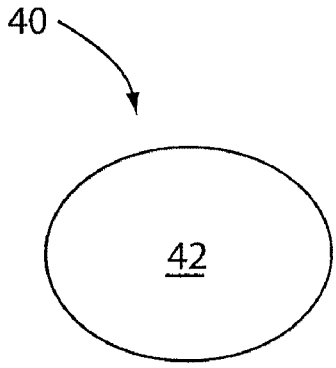
FIG. 8 is a schematic bottom view of another container according to the present invention.

Depicted in FIG. 8 is another embodiment of a plastic particulate coffee container 40 according to the present invention. It will be appreciated that container 40 has an oval base 42 as shown with an identical surrounding oval wall member (not shown) extending upwardly therefrom. Other than a oval footprint, container 40 is thus similar to container 10 (or 30), and could include the same variations thereof as discussed above. In fact, container 10 is well suited to be like any of the containers disclosed in the above identified prior applications which have been incorporated by reference.

Although the preferred embodiments of the rigid containers have been depicted being made of a plastic material, it will be appreciated that the concept of the present invention could also be used with rigid containers of other materials such as, for example, aluminum or steel cans, paperboard cartons, corrugated cartons, or composite (paperboard with a plastic liner or the like) tubes or cartons. Thus, rigid container of these materials could all be provided with a predetermined minimum headspace to effect increased top load strength as discussed above.

While the present invention has been described with respect to exemplary embodiments thereof, it will be understood by those of ordinary skill in the art that variations and modifications can be effected within the scope and spirit of the invention.

We claim:

1. A rigid container for a particulate product with enhanced top load support, comprising:

an interior volume formed by a base, a surrounding wall member upstanding from said base, and a top; and a particulate product provided in said interior volume, said particulate product provided in sufficient quantity to fill said interior volume up to where a predetermined minimum headspace is provided such that said particulate product provides a significant resistance force to compression of the surrounding wall member when a top load on the container is present, the predetermined minimum headspace being that which produces a top load ratio of at least 3:1, where the top load ratio is defined as a ratio of the top load force sufficient to cause a 0.30" deflection in the rigid container when filled to the predetermined minimum headspace and when said particulate product is providing a resistance force to compression over the top load force sufficient to cause a 0.30" deflection in the rigid container when empty.

2. A rigid container as claimed in claim 1, and further including an enlarged top opening in said top and a flexible closure attached to said top and spanning said top opening, wherein said predetermined minimum headspace is also sufficient so that about 20% of said flexible closure contacts a top portion of said particulate product when a pressure of said interior volume is 3 psi less than ambient and causes said flexible closure to flex inward.

3. A rigid container as claimed in claim 1, wherein a top half of said surrounding wall member has a wall thickness which is greater than a wall thickness of a bottom half.

4. A rigid container as claimed in claim 1, wherein a wall thickness of said surrounding wall member changes gradually over a height thereof from adjacent said top to adjacent said base.

5. A rigid container as claimed in claim 1, wherein a portion of said surrounding wall member is generally curved in cross section.

6. A rigid container as claimed in claim 1, wherein said surrounding wall member is rectangular in cross section.

7. A rigid container as claimed in claim 1, wherein the particulate product is compacted coffee.

8. A rigid container as claimed in claim 1, wherein said base, said surrounding wall member and said top are made of a plastic material.

9. A rigid container as claimed in claim 8, further including a flexible closure attached to said top and spanning said top opening, and a one-way valve provided in said flexible closure.

10. A rigid container as claimed in claim 9, wherein said interior volume has a volume of at least one liter.

11. A method for reinforcing a rigid container for a particulate product against top load forces comprising the steps of:

forming a rigid container with a container interior volume formed by a base, a surrounding wall member which is upstanding from the base, and a top which connects with the surrounding wall member and which includes an opening therein; and filling the interior volume with a particulate product so that at least a predetermined minimum headspace is provided such that said particulate product provides a significant resistance force to compression of the surrounding wall member when a top load on the container is present, the predetermined minimum headspace being that which produces a top load ratio of at least 3:1, where the top load ratio is defined as a ratio of the top load force sufficient to cause a 0.30" deflection in the plastic container when filled to the predetermined minimum headspace and when said particulate product is providing a resistive force to compression over the top load force sufficient to cause a 0.30" deflection in the plastic container when empty.

12. A method for reinforcing a rigid container as claimed in claim 11, and further including, after said filling step, the step of attaching a flexible closure to said top and spanning the top opening, wherein the predetermined minimum headspace is also sufficient so that about 20% of the flexible closure contacts a top portion of the particulate product when a pressure of the interior volume is 3 psi less than ambient and this pressure causes the flexible closure to flex inward.

13. A method for reinforcing a rigid container as claimed in claim 11, wherein the particulate product is coffee, and wherein said filling step includes the step of vibrating the particulate coffee.

14. A method for reinforcing a rigid container as claimed in claim 13, wherein said forming step forms the rigid container of a plastic material, and wherein said filling step fills the container with at least one liter of the particulate coffee.

15. A method for reinforcing a rigid container as claimed in claim 11, wherein said filling step includes the steps of providing a one-way valve in a flexible closure and attaching the flexible closure to the top and spanning the top opening.

16. A method for reinforcing a rigid container as claimed in claim 11, wherein said forming step includes creating a wall thickness of the surrounding wall member which is greater adjacent a top half than a bottom half.

17. A method for reinforcing a rigid container as claimed in claim 11, wherein said creating step causes a wall thickness of the surrounding wall member over a height thereof to change gradually from adjacent the top to adjacent the base.

18. A method for reinforcing a rigid container as claimed in claim 11, wherein a portion of the surrounding wall member is generally curved in cross section.

19. A method for reinforcing a rigid container as claimed in claim 11, wherein the surrounding wall member is rectangular in cross section.

20. A rigid container for a particulate coffee with enhanced top load support, comprising:

an interior volume holding at least one liter and formed by a base, a surrounding wall member upstanding from said base, a top with an enlarged opening sufficient for a five inch cylinder to fit therethrough, a flexible closure attached to said top and spanning said top opening, and a one-way valve provided in said flexible closure;

wherein said base, said surrounding wall member and said top are formed of a plastic material, and said surrounding wall member has a wall thickness which is greater adjacent said top than adjacent said base; and a particulate compacted coffee provided in said interior volume, said particulate compacted coffee provided in sufficient quantity to fill said interior volume up to a level where a predetermined minimum headspace is provided such that said particulate product provides a significant resistance force to compression of the surrounding wall member when a top load on the container is present, the predetermined minimum headspace being that which produces a top load ratio of at least 3:1, where the top load ratio is defined as a ratio of the top load force sufficient to cause a 0.30" deflection in the plastic container when filled to the predetermined minimum headspace and when said particulate product is providing a resistive force to compression over the top load force sufficient to cause a 0.30" deflection in the plastic container when empty; and wherein said predetermined minimum headspace is also sufficient so that about 20% of said flexible closure contacts a top portion of said particulate product when a pressure of said interior volume is 3 psi less than ambient and causes said flexible closure to flex inward.

* * * * *